US005461966A

United States Patent [19]

Becker et al.

[11] Patent Number: 5,461,966

[45] Date of Patent: Oct. 31, 1995

[54] MEASURING GAS PUMP

[75] Inventors: Erich Becker, Bad Krozingen; Heinz Riedlinger, Freiburg, both of Germany

[73] Assignee: KNF Neuberger GmbH, Freiburg-Munzingen, Germany

[21] Appl. No.: 269,871

[22] Filed: Jun. 30, 1994

[30] Foreign Application Priority Data

Jul. 5, 1993 [DE] Germany ..... 43 22 272.2

[51] Int. Cl.[6] ..... F15B 21/04

[52] U.S. Cl. ..... 92/1; 92/176; 417/413.1

[58] Field of Search ..... 92/1, 176; 417/373, 417/413.1

[56] References Cited

U.S. PATENT DOCUMENTS

| | | | |
|---|---|---|---|
| 4,049,366 | 9/1977 | Becker | 417/569 |
| 4,507,972 | 4/1985 | Morita | 92/1 |
| 4,624,625 | 11/1986 | Schrenker | 417/20 |
| 4,684,509 | 8/1987 | Bernath | 422/54 |
| 4,790,730 | 12/1988 | Spaeth et al. | 92/1 |

FOREIGN PATENT DOCUMENTS

| | | |
|---|---|---|
| 0279284 | 8/1988 | European Pat. Off. . |
| 8602787 | 4/1986 | Germany . |
| 1231216 | 5/1971 | United Kingdom . |

*Primary Examiner*—Thomas E. Denion
*Attorney, Agent, or Firm*—Panitch Schwarze Jacobs & Nadel

[57] ABSTRACT

A measuring gas pump (1) has a pump chamber (3) closed by means of a working diaphragm (6). The strokes (double-headed arrow 26) are imparted to the working diaphragm (6) by way of a connecting rod or like lifting mechanism (9) from a crank mechanism (10). A heat source (16) is provided in the pump head (15). Provided between the connecting rod head (8) and the crank mechanism (10), there is a heat dissipation barrier (19 and/or 27) with respect to the measuring gas. By means of the measuring gas pump (1), the gas to be delivered thereby can be kept better to the temperature of the gas sampling condition and unwanted condensation of constituents of the gas to be analyzed and falsifications of the measurement result can be avoided or at least significantly reduced.

15 Claims, 3 Drawing Sheets

MEASURING GAS PUMP

FIELD OF THE INVENTION

The invention relates to a measuring gas pump, particularly one having a pump chamber closed by a working diaphragm, wherein the pump stroke is imparted to the diaphragm by a connecting rod or other lifting mechanism from a crankcase, and wherein a heat source is provided in the upper region of the pump case.

BACKGROUND OF THE INVENTION

Such pumps are already known. They serve to deliver hot measuring gases, the temperature of which is to be preserved as far as possible in the sampling condition. Condensation of constituents of the gas to be analyzed, falsification of the measurement result and so on are hence to be avoided. In order that the areas in such hot gas pumps coming into contact with the gas to be measured are kept at the proper temperature, usually predetermined by the sampling point of the gas to be measured, it is already known to incorporate a heating device in the pump head. The heating device is to prevent the temperature of the gas to be measured from falling in the area of the pump chamber or at least to reduce such temperature drop. Such a heating device or heat source is usually realized by an electric heating rod which is fitted, for instance, symmetrically in the pump head near the pump chamber and may be controllable with respect to its heat output.

However, such known measuring gas pumps, to be described in further detail below, still present some drawbacks. They are generally in the form of diaphragm pumps, the stroke being imparted to the diaphragm with the aid of a connecting rod. For this purpose the connecting rod is widened in a mushroom-like fashion at the upper end and engages under the working membrane which is located in position, in the direction of the pump chamber, by a fixing plate at the free end of the connecting rod. The crankcase for the connecting rod is situated beneath the mushroom of the connecting rod. This has the adverse side effect that the connecting rod case produces a cooling effect on the connecting rod mushroom and therefore also on the working diaphragm and directly on the gas to be measured.

If, as is often the case, an electric heating rod is accommodated in the pump head as a heat source, a temperature drop in the pump case ensues from there in the direction of the connecting rod drive. The then unavoidable cooling occurring at the connecting rod head is liable to affect the gas to be delivered and measured. The cooling of the connecting rod head and working diaphragm is partly promoted by air convection or the like occurring with an up-and-down travelling connecting rod in such a way that, as the connecting rod goes up, colder air from the crankcase is delivered into the region of the working diaphragm and, as the connecting rod goes down, heated air there is moved in the direction of the crankcase. As a secondary effect of the diaphragm drive, some regular air convection having a cooling effect on the working diaphragm is unintentionally created.

SUMMARY OF THE INVENTION

Therefore, the object underlying the invention is particularly to improve in a simple way the known measuring gas pumps of the kind described at the outset, so that the measuring gases undergo no change or no significant change in temperature through the measuring gas pump delivering them and the above-described drawbacks are largely obviated.

The above object is accomplished according to the present invention by impeding the dissipation of heat from the heat source and measuring gas on the one hand to the crank mechanism on the other hand. Arranging at least one heat barrier between the connecting rod head and the crank mechanism of the measuring gas pump avoids or at least considerably reduces the unwanted reduction in temperature of the measuring gas.

Additional developments of the present invention are recited in the description below. The use of an at least partially flexible heat conductor provides the advantage that heat from the stationary heat source is also supplied to the connecting rod while moving in operation. Preferably, a heat-shielding diaphragm is provided as a heat dissipation barrier between the working diaphragm and the crankcase. A heat-insulating plate having an opening therethrough for the connecting rod is preferably provided between the heat-shielding diaphragm and crankcase as a further heat dissipation barrier in addition to the heat-shielding diaphragm. This further reduces unwanted cooling of the pump surroundings in the area of the gas to be measured.

Those parts of the measuring gas pump, i.e., the casing head and intermediate casing parts, which are situated in the direct proximity where the measuring is to be conducted through the pump, and are apt to be instrumental in affecting its temperature, are preferably made of a heat-conducting material and communicate in a heat-conducting way with the heat source. By this means as well, the required temperature of the gas to be measured can be kept better at the desired temperature level.

As is known, the connecting rod head is in direct contact with the underside of the working diaphragm and generally has a relatively large radiating surface facing the crankcase. By providing a heat lead from the heat source through the casing parts, and possibly the casing cover, including a flexible strand of good heat-conducting material, such as copper, to the connecting rod head, the connecting rod head, moving in operation, can be fed with heat energy from the heat source by simple means, so that the above-mentioned adverse effects can be reduced at least to a very large extent.

The above-described measures for maintaining the temperature of the hot measuring gas can be augmented by two different measures serving the same objective.

Relatively uniform temperature conditions can be created at the upper part of the pump case by a heat conducting bell or the like enclosing the same. This also promotes the entire pumping operation of the measuring gas taking place uniformly with respect to its temperature and without temperature loss by means of the heat source provided, the latter preferably being controlled in its heat output. The like is achieved through the use of an insulating bell enclosing the casing head, heat source and intermediate casing part(s), by means of which the avoidable heat dissipation losses can be kept small.

BRIEF DESCRIPTION OF THE DRAWINGS

The foregoing summary, as well as the following detailed description of preferred embodiments of the invention, will be better understood when read in conjunction with the appended drawings which show further features and advantages of the invention. For the purpose of illustrating the invention, there are shown in the drawings embodiments which are presently preferred. It should be understood, however, that the invention is not limited to the precise arrangements and instrumentalities shown. The individual features may be realized singly or severally in the measuring gas pump according to the present invention. In the drawings, represented in relatively diagrammatic form.

DETAILED DESCRIPTION OF PREFERRED EMBODIMENTS

Figure 1:
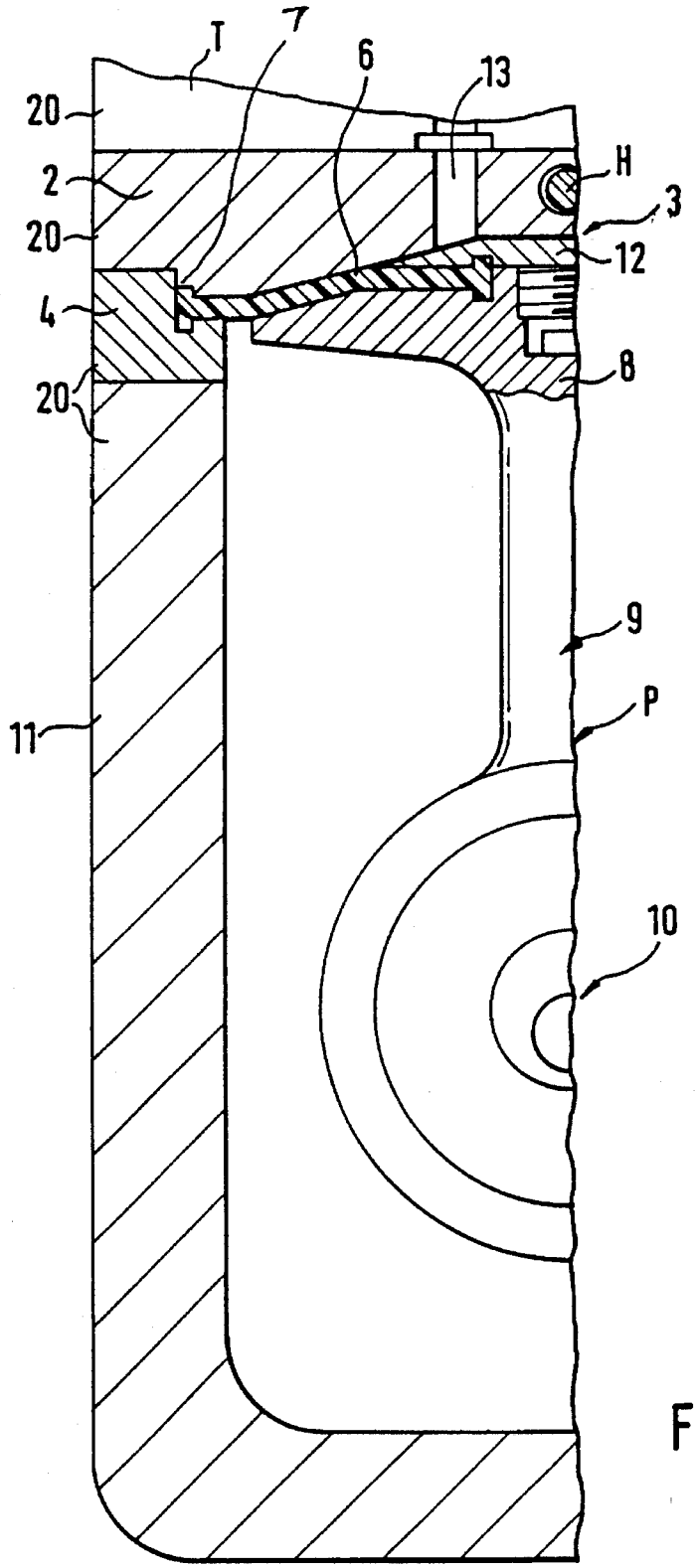
Fig. 1 PRIOR ART
FIG. 1 shows a heated measuring pump of known design, shown in a half side view and partly in section.

FIG. 1 shows a side view, partly in section, of the main casing part of a measuring gas pump of known design. The casing head 2 accommodates the pump chamber 3. An intermediate casing part 4, sealingly clamps the radially outer edge 7 of the working diaphragm 6 together with the casing head 2. The head 8 of the connecting rod, generally designated 9, cooperates in the usual way with a crank mechanism 10 located inside the crankcase 11. In FIG. 1, the drive for the diaphragm 6 takes the form of a connecting rod 9. The connecting rod 9 is in its upper dead point position P in FIG. 1, so that the pump chamber 3 is shown only as an unbroken line. A fixing plate 12 firmly clamps the working diaphragm 6 with its inside edge area to the connecting rod head 8.

Provided centrally in relation to the pump chamber 3 is an electric heating rod H as a heat source for the measuring gas pump. Above the casing head 2 an upper end part T is to be seen in side view in FIG. 1 and is depicted broken away and in schematic form in the area of the inlet port 13 for the measuring gas. Parts T, 2, 4 and 11 essentially constitute the case 20 of the known measuring gas pump according to FIG. 1. It is also apparent how heat supplied above to the pump case 20 by the measuring gas to be delivered and heat source H can radiate downwards in the direction of the crank mechanism 10.

Figure 2:
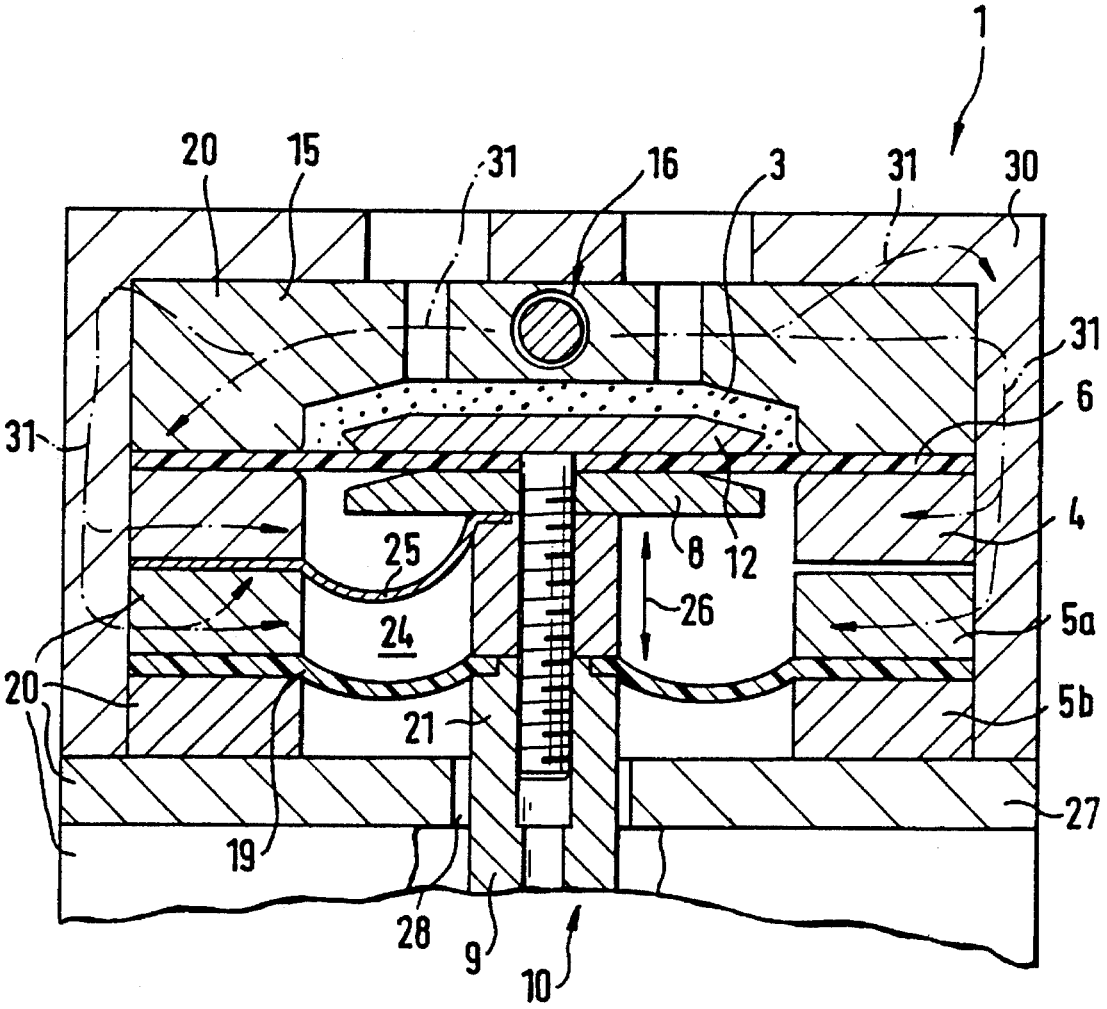
FIG. 2 shows a section through the upper part of a measuring gas pump according to the present invention, similar to the upper area of FIG. 1.

FIG. 2 now shows in schematic form the upper area, modified in accordance with the invention, of a measuring gas pump 1 embodied by the invention. It has a pump chamber 3 closed in the direction of the crank mechanism 10 by means of a working diaphragm 6. This working diaphragm 6 is connected to the crank mechanism 10 by way of a connecting rod 9 or like lifting mechanism. This connecting rod 9 may be part of a pendulum-type piston (FIG. 1) as well as part of a reciprocating piston. A pump head 15 belonging to the entire pump case 20 incorporates the pump chamber 3 as a recess. In addition, this pump head 15 contains a heat source 16, which in the exemplified embodiment is realized in known manner as a heating rod H. The heat output of the heating rod is usually automatically controllable, adapted to the respective requirements of the measuring gas pump 1.

The working diaphragm 6 is sealingly clamped at its inner edge in the usual way between a connecting rod head 8 and a diaphragm fixing plate 12 (referred to in short as "fixing plate 12").

It now constitutes part of the invention that provided between the connecting rod head 8 and the crank mechanism 10 there is at least one heat barrier with respect to the heat source 16 and with respect to the measuring gas (represented by dots) situated in the pump chamber 3. This heat barrier may preferably be formed by a heat-shielding diaphragm 19 which stretches between an edge area of the pump case 20 on the one hand and the shank 21 on the other hand. In the exemplified embodiment this heat-shielding diaphragm 19 is sealingly clamped with its inner edge in the connecting rod shank 21 and with its outer edge between two casing portions **5*a* and 5*b*. In this manner the heat-shielding diaphragm stops the movement of air described at the outset, as is encountered in known measuring gas pumps, between the connecting rod head 8 and the crank mechanism 10. By this means a chamber 24 of relatively small volume is composed between the working diaphragm 6 and the heat-shielding diaphragm 19** and constitutes a heat buffer.

According to a development of the present invention, a heat conductor 25, which is flexible in some sections, is provided between the heat source 16 and the connecting rod head 8. In a manner to be described in further detail below, the heat conductor 25 establishes a heat-conducting communication between the heat source 16 in the pump head and the connecting rod head 8 above the heat-shielding diaphragm 19. Since in this way the heat conductor 25 also supplies heat inside the chamber 24 from the heat source 16 to the connecting rod head 8, it enhances the action of the heat-shielding diaphragm 19 in the sense of the heat barrier desired. The radial length of the heat conductor 25 in the area between the connecting rod head 8 and the intermediate casing parts 4 and **5*a* is dimensioned in such a way that the heat conductor can follow the stroke of the connecting rod head 8. This stroke is indicated by the double-headed arrow 26 in FIG. 2**.

The heat dissipation barrier between heat source 16 and measuring gases on the one hand and the crank mechanism 10 on the other hand is augmented by a heat-insulating plate 27 arranged between the heat-shielding diaphragm 19 and the crank mechanism 10. The heat-insulating plate 27 has an opening 28 therethrough for the connecting rod 9. The heat barrier of the measuring gas pump 1 could also be realized by the above-mentioned heat-insulating plate 27 alone. However, the use of a heat-shielding diaphragm 19, possibly supplemented by the heat-insulating plate 27, is more advantageous.

Figure 3:
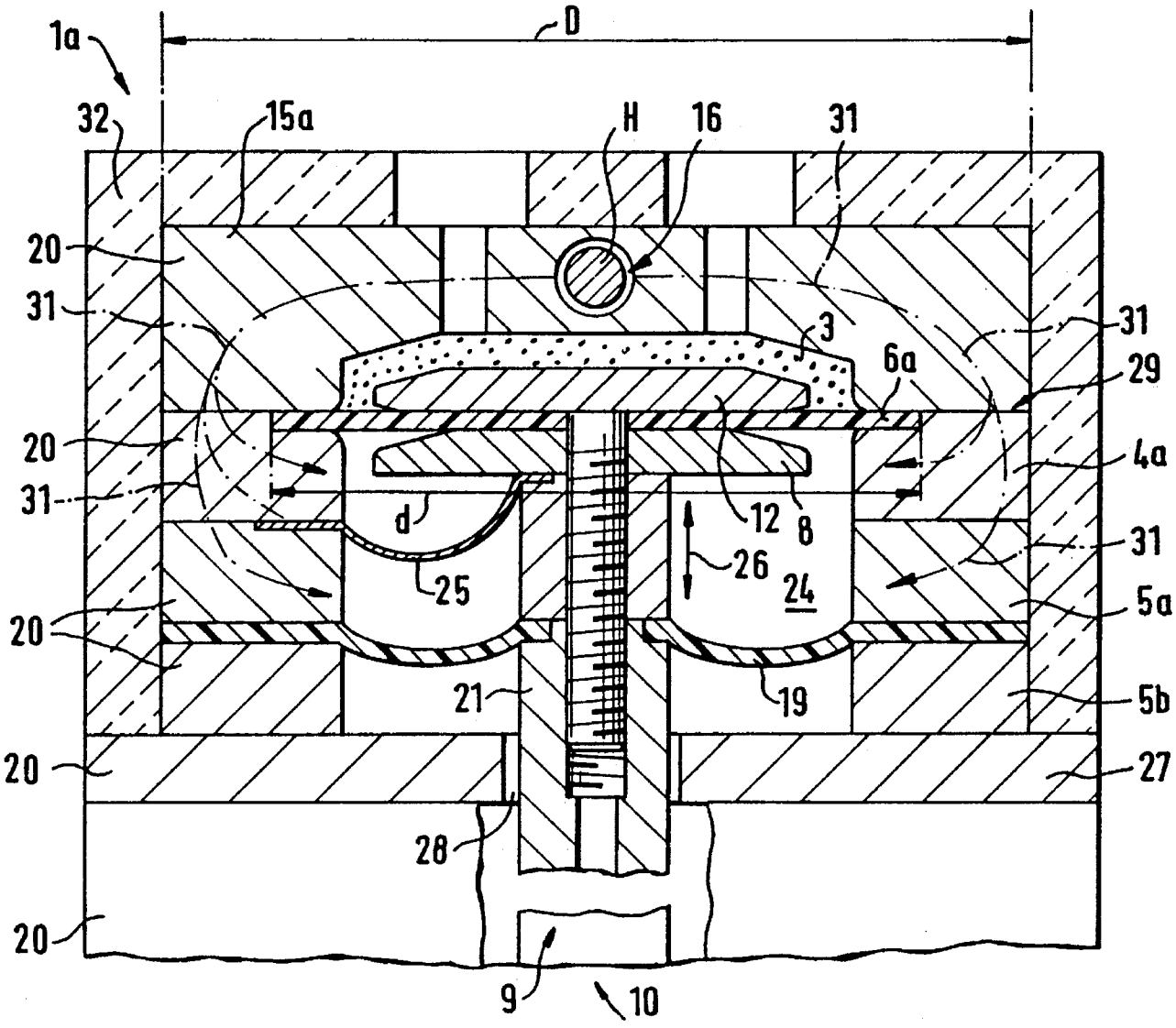
FIG. 3 shows a section through the upper area of a measuring gas pump according to the present invention, similar to FIG. 2, but in a slightly modified embodiment.

FIG. 3 shows a special modification of the above-described design according to FIG. 2, concerning the heat flow from the heat source 16 to the heat conductor 25. In FIG. 3 the diameter d of the working diaphragm **6*a* is smaller than the diameter D of the case 20, in particular is smaller than the diameter D of the pump head 15*a* and intermediate casing part 4*a* adjacent to the latter. The above-mentioned parts 15*a* and 4*a* are in heat-conducting contact in their mutual interface area 29. The heat flow thereby possible, beginning at the heat source 16, is indicated by the dash-dotted arrows 31. One sees that in the present embodiment 1*a* of the measuring gas pump, the heat source 16 is well able to supply heat energy to the partly elastic or flexible heat conductor 25, so that the connecting rod head 8 and hence the working diaphragm 6*a* are also indirectly heated up from beneath. This contributes towards uniform temperature regulation of the working diaphragm 6*a***.

The case head **15*a* and the adjacent intermediate casing part 4*a* comprises heat-conducting material, and these two part 4*a*, 15*a* are in heat-conducting communication radially outside the working diaphragm 6*a*. The heat conductor 25 preferably consists of a flexible heat lead. The heat conductor obtains its heat supply from the heat source 16, via the pump head 15 and intermediate casing part 4*a*, but preferably also through the casing part 5*a* located underneath and adjacent to the heat conductor 25. The heat conductor 25, which suitably consists of a flexible strand of good heat conductivity, made of copper or similar heat-conducting material, then conducts this heat to the connecting rod head 8, as may be seen well from FIG. 2 and particularly FIG. 3**.

In the embodiment of FIG. 2, the casing head 15, the heat source 16 therein, as well as at least one intermediate casing part 4, and preferably the three intermediate casing parts 4, 5*a* and 5*b*, are enveloped by a heat-conducting bell 30 or similar heat-conducting cover in such a way that the heat-conducting bell 30 can also give off the heat conveyed therein from the casing head 15 to the intermediate casing parts 4, 5*a* 5*b*, as shown by arrows 31. The heat-conducting bell 30 is preferably composed of aluminum.

FIG. 3 depicts a measuring gas pump 1*a* with somewhat modified covering of the upper part of the case 20. There, a pump part enveloping parts 15*a*, 4*a*, 5*a* and 5*b* of the case 20 in a bell-like manner comprises an insulating bell 32 of a material which is not heat conducting but can adequately accommodate the temperature expansions of the above-mentioned parts 15, 4*a*, 5*a* and 5*b*. Such an insulating bell may, for instance, comprise glass, ceramics or similar material, it being possible for any difference in the coefficient of temperature expansion to be equalized by a gap, an elastic mass or the like.

All the individual features described above and/or recited in the claims may be of material importance to the invention in their own right or in any combined form. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A measuring gas pump (1, 1*a*) comprising a pump case (20) having a pump chamber (3) closed by means of a working diaphragm (6), a connecting rod (9) for imparting a stroke from a crank mechanism (10) to the working diaphragm via a connecting rod head (8), a heat source (16) provided in an upper region of the pump case (20), and at least one heat barrier (19) which contacts the connecting rod (9) located between the connecting rod head (8) and the crank mechanism (20), said barrier impeding dissipation of heat from the heat source (16) and a measuring gas on the one hand and the crank mechanism (20) on the other hand.

2. A measuring gas pump according to claim 1, further comprising a heat conductor (25) provided between the heat source (16) and the connecting rod head (8).

3. A measuring gas pump according to claim 2, wherein the heat conductor (25) is flexible in at least some section thereof.

4. A measuring gas pump according to claim 1, wherein said heat barrier comprises a heat-shielding diaphragm (19) connecting a pump casing part (4, 5*a*, 5*b*) to a connecting rod shank (21).

5. A measuring gas pump according to claim 1, further comprising a heat-insulating plate (27) having an opening (28) therethrough for receiving the connecting rod (9).

6. A measuring gas pump according to claim 4, further comprising an additional heat dissipation barrier in the form of heat-insulating plate (27) having an opening (28) therethrough for receiving the connecting rod (9).

7. A measuring gas pump according to claim 1, wherein a casing head (15*a*) and at least one adjacent intermediate casing part (4*a*) comprise heat-conducting material and are in heat-conducting communication, the heat source (16) being accommodated in the casing head (15*a*).

8. A measuring gas pump according to claim 2, wherein the heat conductor (25) includes a heat lead from a region surrounding the heat source (16) to the connecting rod head (8), and said heat conductor comprises a flexible strand of heat-conducting material having good heat conductivity.

9. A measuring gas pump according to claim 8, wherein said head lead extends through at least one intermediate part (4, 5*a*, 5*b*) of the pump casing (20).

10. A measuring gas pump according to claim 8, wherein said flexible strand comprises copper.

11. A measuring gas pump according to claim 1, wherein a casing head (15), heat source (16) and at least one intermediate casing part (4, 5*a*, 5*b*) are enveloped in a heat-conducting manner by a heat-conducting bell (30).

12. A measuring gas pump according to claim 11, wherein said heat-conducting bell (30) comprises aluminum.

13. A measuring gas pump according to claim 4, wherein a casing head (15), heat source (16) and at least one intermediate casing part (4, 5*a*, 5*b*) extending to the heat-shielding diaphragm (19) are in heat conducting communication.

14. A measuring gas pump according to claim 13, wherein said casing head (15), heat source (16) and casing parts (4, 5*a*, 5*b*) are enclosed by an insulating bell (32).

15. A measuring gas pump according to claim 1, wherein the working diaphragm (6*a*) has a smaller outside diameter (d) than adjacent parts (4*a*, 5*b*) of casing (20), and the casing parts are in heat-conducting communication radially outwardly from the working diaphragm (6*a*).

* * * * *